US005548111A

United States Patent [19]

Nurmi et al.

[11] Patent Number: 5,548,111

[45] Date of Patent: Aug. 20, 1996

[54] PHOTOMULTIPLIER HAVING GAIN STABILIZATION MEANS

[75] Inventors: Jarmo Nurmi, Kuusistø; Timo Oikari, Turku, both of Finland

[73] Assignee: Wallac Oy, Turku, Finland

[21] Appl. No.: 392,248

[22] Filed: Feb. 22, 1995

[51] Int. Cl.[6] ..... H01J 40/14

[52] U.S. Cl. ..... 250/207; 313/533

[58] Field of Search ..... 250/207, 214 VT, 250/214 R, 369, 354.1, 361 R; 313/532, 533, 534, 535, 536

[56] References Cited

U.S. PATENT DOCUMENTS

| | | | |
|---|---|---|---|
| 3,183,353 | 5/1965 | Baldwin | 250/207 |
| 3,515,878 | 6/1970 | Ried, Jr. et al. | 250/207 |
| 3,714,441 | 1/1973 | Kreda | 250/207 |
| 4,160,165 | 7/1979 | McCombs et al. | 250/361 R |
| 4,220,851 | 9/1980 | Whatley, Jr. | 250/252.1 |
| 4,661,693 | 4/1987 | Masanobu | 250/207 |
| 5,004,904 | 4/1991 | Yamakawa et al. | 250/207 |
| 5,157,250 | 10/1992 | Oikari et al. | 250/207 |

*Primary Examiner*—Edward P. Westin
*Assistant Examiner*—John R. Lee
*Attorney, Agent, or Firm*—Ronald J. Kubovcik

[57] ABSTRACT

A gain stabilization system for photomultiplier tubes using a pulsed light source, preferably a light emitting diode (LED), the signal of which is detected at the cathode and at the anode. The gain of photomultiplier tube is stabilized by keeping the ratio between the two signals constant.

20 Claims, 3 Drawing Sheets

PHOTOMULTIPLIER HAVING GAIN STABILIZATION MEANS

BACKGROUND OF THE INVENTION

1. Field of the Invention

The present invention generally relates to photomultiplier tubes (PMT) and more particularly to an automatic gain stabilization system used with photomultiplier tubes.

2. Description of the Prior Art

Photomultiplier tubes, hereby shortly referred to as photomultipliers, are common instruments in science and technology for detecting weak light levels. The photomultiplier typically consists of a photosensitive cathode, a chain of secondary emission electrodes called dynodes and an output electrode called an anode with electric potentials arranged between them. The operation principle is as follows:

Light flux hits the cathode which converts light photons into free electrons. The applied voltage directs the free electrons to the first dynode. One electron liberates several secondary electrons from the first dynode in a process called secondary emission. These secondary electrons are in turn directed to the next dynode where the secondary emission process also happens. These steps are repeated on every dynode.

The gain of the photomultiplier is defined as the ratio of the anode current to the cathode current. The gain is typically from $10^2$ to $10^8$ depending on the number of dynodes, on interdynode voltages and on the dynode materials. The gain should naturally remain stable during the operation in order to yield ideal performance for the light detecting device. Unfortunately this is not usually achieved because the gain tends to drift with the temperature, with variable light fluxes and with ageing of the photomultiplier.

For correcting the gain instabilities a known solution is to employ a supplementary pulsed light source with standardized intensity to monitor the output of the photomultiplier and to adjust the gain according to the obtained signal by, e.g. a feedback loop as presented by Ried and Gilland (U.S. Pat. No. 3,515,878). The pulsed light source can be e.g., a low-intensity lamp, a light emitting diode (LED) or a radioactive isotope in conjunction with an appropriate scintillator.

Another solution is to monitor the first dynode pulse height and adjust an LED amplitude with it as presented by Oikari and Nurmi (U.S. Pat. No. 5,157,250). This solution provides a photomultiplier tube with a gain stabilization system that is insensitive to the drifts encountered with the stabilization light sources. A problem in this solution is that the anode pulse capacitively affects the first dynode. That is why later dynode voltages must be removed during measuring of the first dynode voltage.

SUMMARY OF THE INVENTION

A according to the method of the invention the signal of the light source is detected both at the cathode and at the anode. The light source is preferably a light emitting diode (LED). The signal of the light source will be detected when the voltages of the photomultiplier tube are on.

The signal can be detected simultaneously or one after another at the cathode and at the anode. By keeping the ratio between these two signals constant the actual gain of the photomultiplier tube will be stabilized and the possible drifts in the intensity of the light source will be eliminated.

The gain of the photomultiplier is the ratio between the anode current ($I_A$) and the cathode current ($I_C$). This is equivalent to the ratio between the number of electrons at the anode and the number of electrons leaving the cathode.

The electrons at the cathode will be achieved by the light flux emitted by an LED. When this light flux hits the cathode it converts the light photons into free electrons. The applied voltage directs these electrons from the cathode to the first dynode where the electron liberates several secondary electrons. The applied voltage directs these electrons from the first dynode to the next dynode where the electron liberates again several secondary electrons.

The number of photons emitted by a LED light pulse is approximately equivalent to the product of the LED current multiplied by the time. Typically that number is about a few thousand photons in one flash. Because the quantum efficiency (QE) is about 10% the number of electrons released by these photons is about a few hundred.

At the cathode one LED pulse causes the charge $$Q_C=N*Q,$$

where

N=number of electrons released by photons

Q=charge of one electron=$1.6*10^{-19}$ coulombs

So the cathode current is $$I_C=f*Q_C=f*N*Q,$$

where f=frequency of the light pulse;

Respectively at the anode one LED pulse causes the charge $$Q_A=N*Q*G,$$

where

N=number of electrons released by photons

Q=charge of one electron=$1.6 * 10^{-19}$ coulombs

G=gain of the photomultiplier

So the anode current is $$I_A=f*Q_A=f*N*Q*G,$$

where f=frequency of the light pulse

Typically the frequency of the light pulse is about a few thousand pulses per second. So the direct cathode current ($I_C$) rise is about some picoamperes (pA=$10^{-12}$A) and it can be measured. Respectively the anode current $I_A=G * I_C$ is about a few microamperes (uA=$10^{-6}$A).

By stabilizing the ratio between the anode current and the cathode current the actual gain of the photomultiplier will be stabilized. Another embodiment is to stabilize the ratio between the anode charge and the cathode current. In this embodiment the frequency of the pulse must be taken into account. In both of these embodiments the effect of possible drifts in the intensity of the stabilization source will be eliminated.

The above and other features and advantages of the invention will become better understood by reference to the detailed description that follows, when considered in connection with the accompanying drawings.

DETAILED DESCRIPTION OF A PREFERRED EMBODIMENTS

The gain stabilization cycle in the invention consists of two phases where the signals produced by the stabilization source will be measured. The first phase is the detection of the signal at the cathode and the second phase is the detection of the signal at the output electrode, most commonly at the anode.

In first phase the LED pulse frequency is high to override both the noise of the amplifier and the noise of the light signal source. In the second phase the actual light signal source measurement will then take place.

Figure 1:
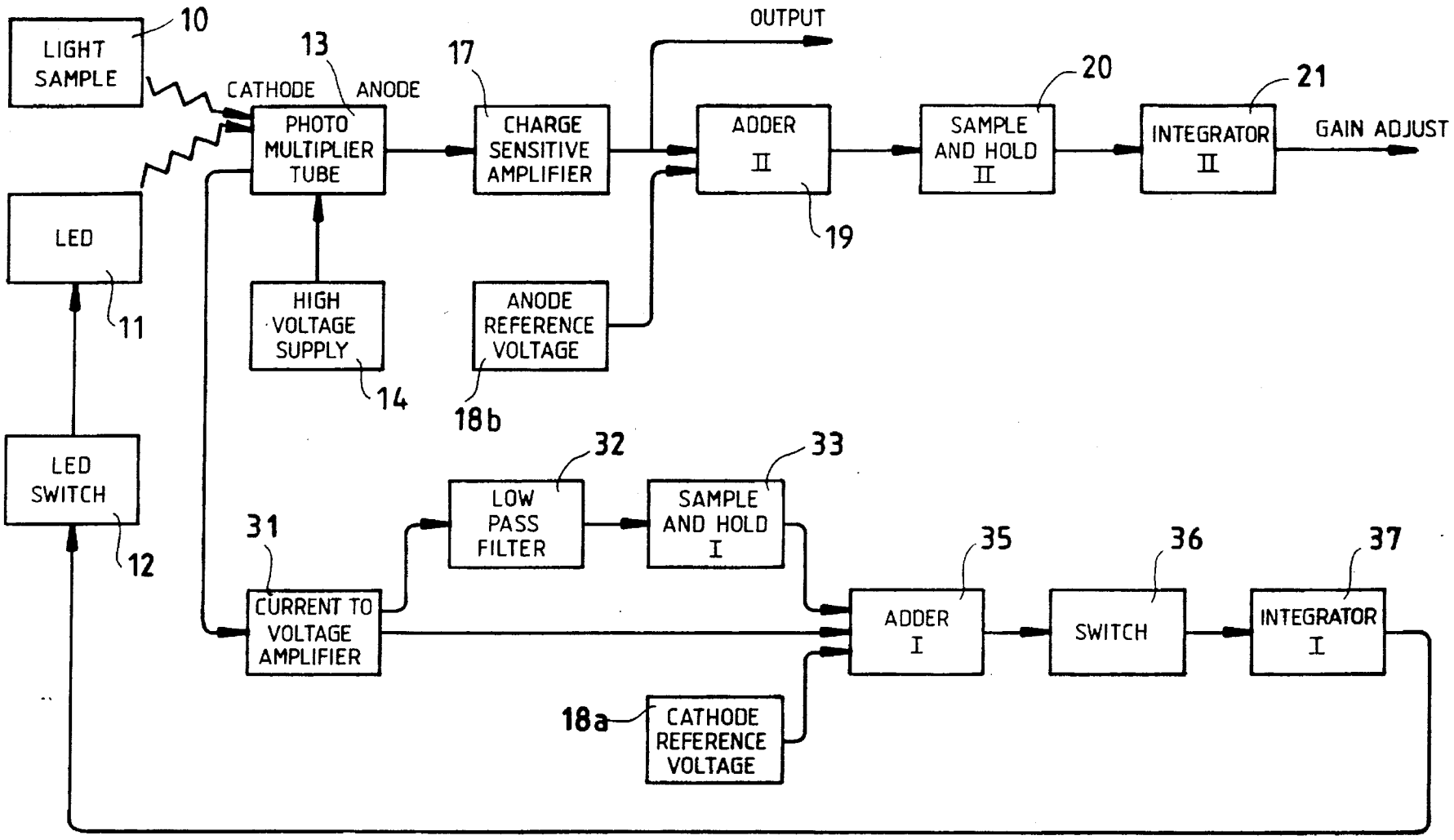
FIG. 1 is a block diagram of a first embodiment of the invention.
Figure 2:
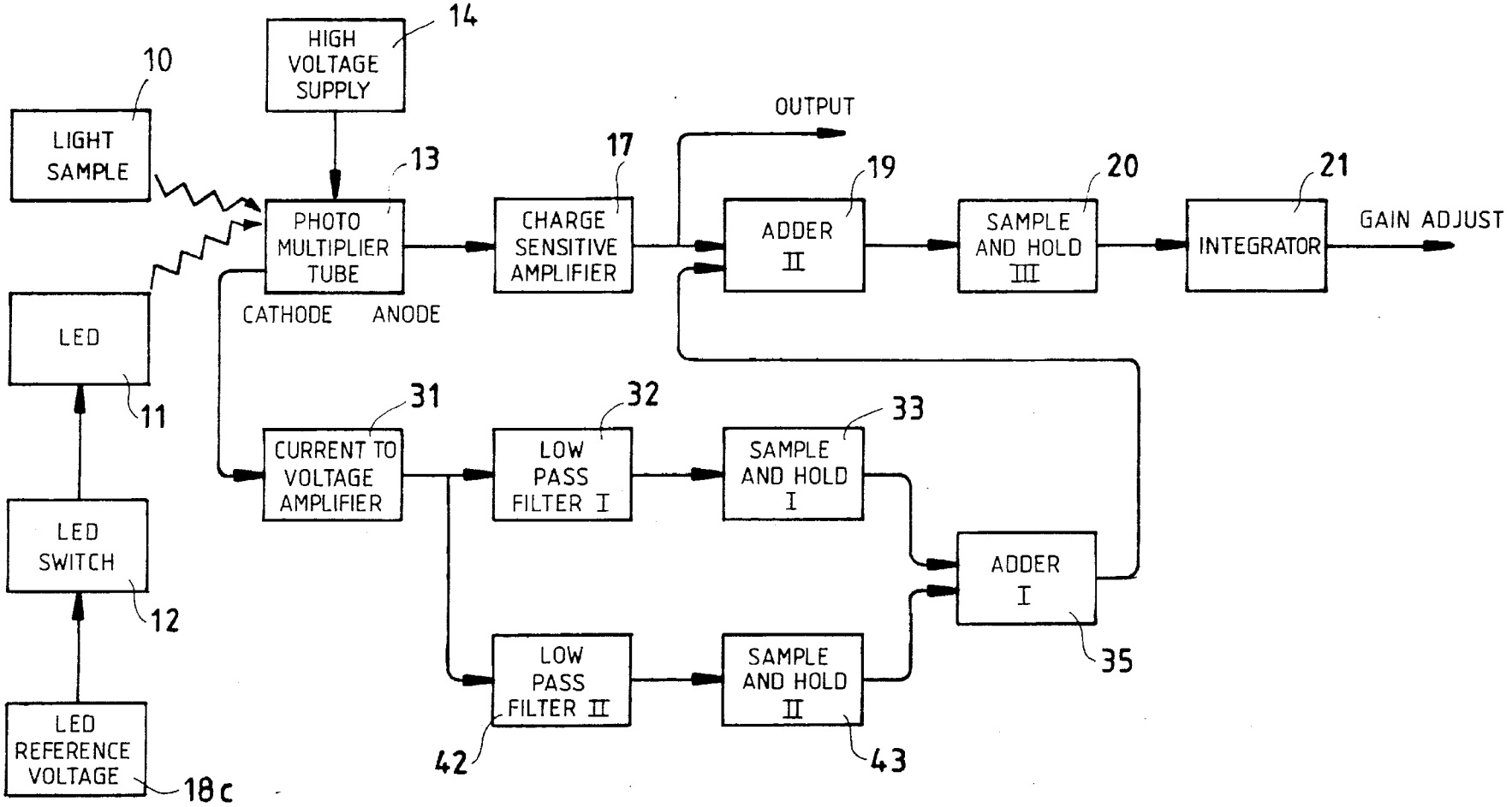
FIG. 2 is a block diagram of a second embodiment of the invention.

In FIG. 1 and in FIG. 2 the invention has been described by the electronic circuitries presented by blocks. These circuitries are well known and can easily be constructed by those skilled in the art. Therefore the units themselves have not been described, only their connection to the overall system operation.

In FIG. 1 is presented a first embodiment of the invention. At the beginning of the first phase the LED is off and the cathode current is measured by current to voltage amplifier 31. The voltage equivalent to the cathode current is filtered by low pass filter 32 and stored to a first sample and hold (S/H) circuit 33.

Then the LED 11 is pulsed by the LED switch 12 at a frequency, e.g., 10 kHz and the integrator switch 36 connects the first adder 35 to the first integrator 37. Then the first integrator 37 adjusts the light source 11 (LED) so that first integrator input will be zero. The adjustment principles in this phase are as follows. The signals coming from the current to voltage amplifier 31, from the first sample and hold (S/H) circuit 33 and from the cathode reference voltage **18*a* are connected to the input of the first adder 35. The first integrator 37 adjusts the light source 11 by calculating all of the above mentioned three input signals coming to the first adder 35. The signal from the first sample and hold (S/H) circuit 33 and the signal from the cathode reference voltage 18*a* will be subtracted from the signals coming from the current to voltage amplifier 31 and from the first sample and hold (S/H) circuit 33. This is because the sum of all these three input signals coming to the first integrator 37** must be zero.

This above said operation of the first adder 35 and the first integrator 37 can be described by the formula:

$$U_A = U_{CVA} - U_{S/H} - U_{RV} = 0,$$

where $U_A$=output of the first adder 35

$U_{CVA}$=output of the current to voltage amplifier 31

$U_{S/H}$=output of the first sample and hold (S/H) circuit 33

$U_{RV}$=output of the cathode reference voltage **18*a***

In the signal at the output of the first sample and hold (S/H) circuit 33 there are also included the photomultiplier (PMT) 13 cathode leakage current, the current caused by the light signal source and the current to voltage amplifier 31 offset current. So these are eliminated by the aid of the first sample and hold (S/H) circuit 33. The PMT 13 supply voltages from the high voltage supply 14 are kept fixed or constant during the above described phase one. At the end of the phase one the integrator switch 36 will be set off and the first integrator 37 stops. The voltage of the first integrator 37 is now stored.

The second phase begins with the gain adjustment. Now the flash amplitude of the LED 11 will be held at the level of the phase one by recalling the stored voltage of the first integrator 37. The frequency of the LED 11 can be, e.g., 1 kHz. The gain is adjusted by the PMT 13 voltages or by the output amplifier 17 gain.

In this embodiment of FIG. 1 the output amplifier 17 is a charge sensitive amplifier and its input is connected to the anode of PMT 13 or a dynode. The second adder 19 output corresponds to the output of the output amplifier 17 minus the anode reference voltage **18*b*. The second sample and hold circuit 20 takes a sample from LED flash and holds the voltage until the next LED 11 flash appears. The second integrator 21 will settle slowly to the right value. The speed of the second integrator 21** is selected so that the gain fluctuations are small enough.

Now the actual light sample 10 measurement can start. The measurement will be interrupted 10 times per second for the gain stabilization with one LED 11 flash and a 100 microsecond inhibit time to get time for the PMT 13 to recover from the light pulse. The phase one will be repeated after 100 seconds so that the system can follow possible temperature changes.

In the alternative embodiment where the ratio between the anode current and the cathode current will be stabilized the output amplifier 17 is a direct current amplifier (DC amplifier) connected straight to the photomultiplier tube.

The second embodiment of the invention is presented in FIG. 2. Many of its blocks are identical with those in FIG. 1 and the same numerals are used for them. At the beginning of the first phase the LED is off and the cathode current is measured by current to voltage amplifier 31. The cathode current is filtered by the first low pass filter 32 and stored to the first sample and hold (S/H) circuit 33. Then the LED 11 is pulsed by the LED switch 12. The LED frequency is, e.g., 10 kHz and the LED amplitude is the amplitude obtained from the LED reference **18*c***.

The cathode current is filtered by the second low pass filter 42 and stored to a second sample and hold (S/H) circuit 43. The first adder 35 calculates the difference between the voltages stored at the first sample and hold (S/H) circuit 33 and at the second sample and hold (S/H) circuit 43. The output of the first adder 35 corresponds to the cathode current rise due to LED pulses.

The LED 11 flash amplitude is fixed to a proper level. The cathode current rise due to the LED 11 pulses with a constant frequency measured as described above in the first phase will be used as a reference voltage for output pulse at phase two. LED amplitude does not affect the gain stabilization.

Figure 3:
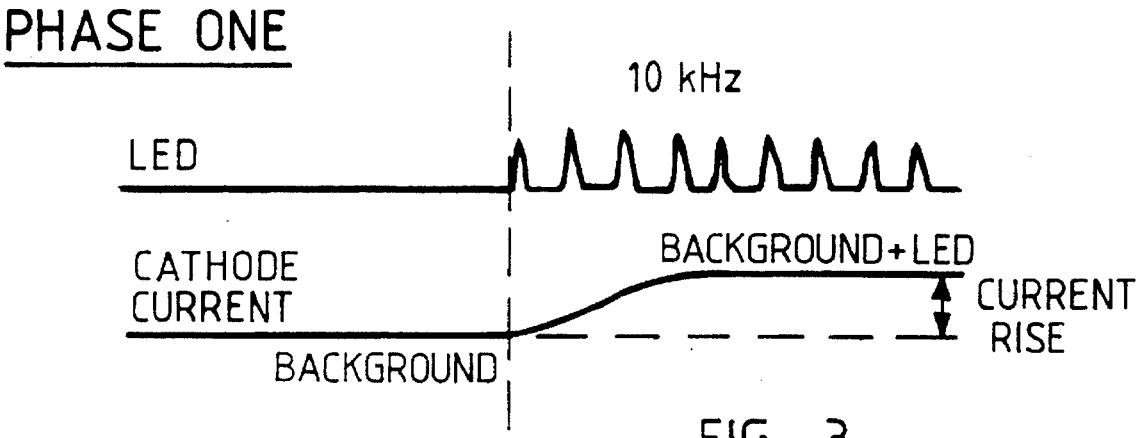
FIG. 3 is the timing diagram of the first phase of the invention.

FIG. 3 presents the timing diagram of the first phase and the cathode current rise during LED pulses after low pass filter 32. At the beginning the LED is off and the cathode current is measured. Then the LED 11 is pulsed at a frequency of 10 kHz and the first integrator 37 adjusts the light source 11. In FIG. 1 the first integrator 37 adjusts the amplitude of the light source 11 so that integrator input will be zero. In FIG. 2 the cathode current is measured and stored.

Figure 4:
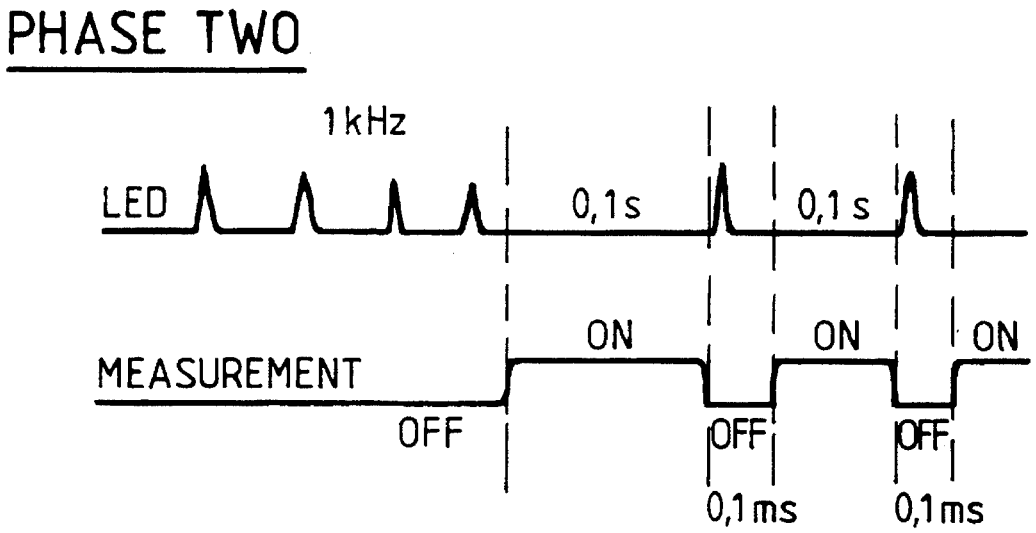
FIG. 4 is the timing diagram of the second phase of the invention.

FIG. 4 presents the timing diagram of the second phase. Before the measurement the flash frequency is 1 kHz. The frequency rate of 1000 flashes per second is to adjust the gain. When the actual light sample 10 measurement starts the measurement will be interrupted 10 times per second for the gain stabilization with one LED 11 flash. For every flash a 0.1 ms inhibit time is needed to recover the PMT 13 from the light pulse. So the measurement cycle will be 0.1 s with 0.1 ms interruption or inhibit time.

The second phase will be interrupted every 100 seconds by the first phase presented in FIG. 3. The reason for it is that then the system can follow possible temperature changes. The first and second phases will be alternated continuously one after the other during the whole measurement.

We claim:

1. A method for stabilizing the gain of a photomultiplier system using a stabilizing light source, comprising:

detecting a signal of stabilization light source when the voltages of a photomultiplier tube are on, both at a cathode of the photomultiplier tube and at an output of the photomultiplier system, said detecting comprising a first phase and a second phase, wherein in the first phase a first signal is detected at the cathode by measuring cathode current, the cathode current caused by the stabilization light source being used for stabilization;

in the second phase a second signal is detected at the system output, and the actual gain of the photomultiplier system is stabilized by keeping the ratio between said two signals constant.

2. A method according to claim 1, wherein the actual gain of the photomultiplier system is stabilized by adjusting the gain of the photomultiplier so that the ratio between the said first signal and the said second signal is constant.

3. A method according to claim 1, wherein at the beginning of the first phase the stabilization light source is off and the direct cathode current is measured to determine a cathode reference, at the end of the first phase the stabilization light source is activated at a constant frequency and its amplitude is adjusted so that cathode current rise equals the cathode reference, the amplitude of the stabilization light source is stored, and in the second phase the stored amplitude of the stabilization light source is used to adjust the gain of photomultiplier or the gain of the amplifier so that the output equals an anode reference.

4. A method according to claim 1, wherein at the beginning of the first phase the stabilization light source is off and direct cathode current is measured, at the end of the first phase the stabilization light source is activated at a constant frequency and constant amplitude, cathode current rise is measured and stored as a stored reference, in the second phase the stored reference is used to adjust the gain of photomultiplier or the gain of the amplifier so that the output equals the stored reference.

5. The method of claim 1, wherein said system output is an anode.

6. A method according to claim 5, wherein in the second phase the second signal is detected at the anode by measuring anode current, the actual gain of the photomultiplier system is stabilized by keeping the ratio between anode current and cathode current constant.

7. A method according to claim 5, wherein in the second phase the second signal is detected at the anode by measuring anode charge, the actual gain of the photomultiplier system is stabilized by keeping the ratio between anode charge and cathode current constant.

8. The method of claim 1, wherein the second signal is detected at an amplifier output.

9. A method according to claim 8, wherein the actual gain of the photomultiplier system is stabilized by adjusting the gain of the amplifier so that the ratio between said first signal and said second signal is constant.

10. The method of any one of claims 1, 2–4, 5 and 8, wherein said stabilization light source is a light emitting diode.

11. Photomultiplier system having a system output, a cathode, a plurality of dynodes and a gain stabilization means, said gain stabilization means comprising;

a light source for producing light flashes at constant frequency to be detected when the voltages of photomultiplier tube are on, means connected to a cathode for detecting a first signal produced by said light flashes at said cathode by measuring cathode current, means for storing the cathode current, means connected to the system output for detecting a second signal produced by said light flashes at said system output, means for adjusting a gain of the photomultiplier system so that the ratio between said two signals is constant.

12. Photomultiplier system according to claim 11, the stabilization means comprising:

means for stabilizing the actual gain of the photomultiplier system by adjusting the gain of the photomultiplier so that the ratio between said first signal and said second signal is constant.

13. Photomultiplier system according to claim 11, the stabilization means comprising:

means for measuring cathode current rise, a cathode reference, means for adjusting the amplitude of the light source so that the cathode current rise equals the cathode reference, means for storing the amplitude of the stabilization light source, means for using the stored amplitude to adjust the gain of the photomultiplier or the gain of the amplifier so that the output equals an anode reference.

14. Photomultiplier according to claim 11, the stabilization means comprising:

means for measuring cathode current, means for measuring cathode current rise after activating the stabilization light source, means for storing the cathode current rise as a reference, means for adjusting the gain of photomultiplier or the gain of the amplifier so that the output equals said stored reference.

15. Photomultiplier system of claim 11, wherein said system output is an anode.

16. Photomultiplier system according to claim 15, the stabilization means comprising:

means for detecting in the second phase the second signal at the anode by measuring anode current, and means for stabilizing the actual gain of the photomultiplier system by keeping the ratio between anode current and cathode current constant.

17. Photomultiplier system according to claim 15, the stabilization means comprising:

means for detecting in the second phase the second signal at the anode by measuring anode charge, and means for stabilizing the actual gain of the photomultiplier system by keeping the ratio between anode charge and cathode current constant.

18. Photomultiplier system of claim 11, wherein the second signal is detected at an amplifier output.

19. Photomultiplier system according to claim 18, the stabilization comprising:

means for stabilizing the actual gain of the photomultiplier system by adjusting the gain of the amplifier so that the ratio between said first signal and said second signal is constant.

20. Photomultiplier system of any one of claims 11, 12–14, 15 and 18, wherein said light source is a light emitting diode.

* * * * *